United States Patent [19]

Tsutsui

[11] Patent Number: 4,565,759

[45] Date of Patent: Jan. 21, 1986

[54] PLATES FOR USE IN LITHOGRAPHIC PRINTING

[75] Inventor: Kyoji Tsutsui, Mishima, Japan

[73] Assignee: Ricoh Co., Ltd., Tokyo, Japan

[21] Appl. No.: 618,604

[22] Filed: Jun. 8, 1984

[30] Foreign Application Priority Data

Jun. 16, 1983 [JP] Japan ..... 58-106733

[51] Int. Cl.[4] ..... G03G 5/14; G03G 13/28

[52] U.S. Cl. ..... 430/66; 430/49; 430/67

[58] Field of Search ..... 430/49, 66, 67

[56] References Cited

U.S. PATENT DOCUMENTS 3,753,709 8/1973 Standenmayer et al. ..... 430/67 X
4,006,020 2/1977 Polastri ..... 430/67

FOREIGN PATENT DOCUMENTS 50-98330 8/1975 Japan ..... 430/67
55-156956 12/1980 Japan ..... 430/66

*Primary Examiner*—Roland E. Martin
*Attorney, Agent, or Firm*—Flynn, Thiel, Boutell & Tanis

[57] ABSTRACT

A plate for use in lithographic printing which comprises providing a photoconductive layer on an electrically conductive substrate and further providing thereon a surface layer (a hydrophilicable layer) consisting essentially of a reaction product of a resin having an acid anhydride group with a crosslinking agent.

8 Claims, 4 Drawing Figures

PLATES FOR USE IN LITHOGRAPHIC PRINTING

BACKGROUND OF THE INVENTION (a) Field of the Invention

The present invention relates to a plate for use in lithographic printing made by electrophotography, in particular it relates to a plate for use in lithographic printing which comprises a photoconductive layer and a layer having a specific property (a layer whose surface changes from a hydrophobic one into a hydrophilic one) superimposed on said photoconductive layer. The term "plate" means a printing plate before plate making.

(b) Description of the Prior Art

Various type of plates for use in lithographic printing (which are sometimes called "plate" for short hereinafter) have hitherto been proposed and put to practical use. For instance, (i) The plate comprising a substrate and a photosensitive resin layer superposed thereon, (ii) The plate comprising a substrate and a layer, superposed thereon, which is made of a silver halide photosensitive material, (iii) The plate comprising an electrically conductive substrate and a layer, superposed thereon, which is made of a photoconductive material, and the like.

The plate (PS plate) disclosed in the preceding example (i) is superior in printing durability but inferior in sensitivity. In view of this, this plate must be exposed to a large output amount of ultraviolet rays for a long period of time at the plate making time. Further, direct plate making, wherein a plate is made directly from the original, is not applicable to this plate, a negative or a positive must be prepared once from the original by using a silver salt film. Therefore, this plate possesses a drawback in that large-scale equipment is required for making this plate, a large amount of time is consumed in making the plate.

The plate disclosed in the preceding example (ii) is made by using the diffusion-transfer developing process or the tanning development process. This plate profitably can be directly made, but has the drawbacks that printing durability is low and the cost per one piece of plate is high.

The plate disclosed in the preceding example (iii) is universally employed for the purpose of direct plate making, and various types of plates have been proposed up to now. Such plates include the inorganic photoconductive material-resin dispersion system once and the organic photoconductive compound-resin system one.

(1) The plate is prepared by forming a photosensitive layer (photoconductive layer) comprising zinc oxide and a binder resin on a conductive-treated substrate (electrically conductive substrate). This plate is generally prepared by forming a toner image on the photosensitive layer through the steps of electrification-imagewise exposure-development using a toner-fixing substance and successively treating the toner-free non-image area of said image so that it becomes hydrophilic by using a so-called etching liquid (for instance, an aqueous acidic solution containing ferrocyanic salt or ferricyanic salt). This printing plate, whose surface alone is subjected to hydrophilicable treatment, is profitable in that the plate making can be effected in a short length of time by means of simple equipment, but the zinc oxide-resin system photosensitive layer is insufficient in strength as the photosensitive layer is destroyed through being peeled off by mechanical pressure applied thereon during printing, by permeation of a moistening agent into the photosensitive layer and the electrically conductive substrate and attachment of ink to the non-image area takes place to thereby limit the printing durability to about 5,000–10,000 sheets.

(2) The plate prepared by forming a photosensitive layer on a finely uneven aluminum plate, said photosensitive layer comprising binding an oxadiazole compound or oxazole compound with an alkali soluble resin such as a styrene-maleic anhydride copolymer or the like. This plate is made by forming a toner image on the photosensitive layer by means of electrophotography process and thereafter dissolving the photosensitive layer corresponding to a non-image area with an alkalline organic solvent and removing. However, this plate making process involves unsettled problems such as cost, safety, environmental pollution, working conditions, sanitary conditions and the like. This plate making process requires large-scale equipment due to the necessity of dissolving and removing the non-image area of the photosensitive layer, the process is time consuming and thereby slows the plate making process, and further employs ethylene glycol, glycerine, methanol, ethanol and the like as the treating liquid (said organic solvent).

(3) The plate prepared by forming a photosensitive layer on a finely uneven aluminum plate, said photosensitive layer comprising a phthalocyanine pigment and an alkali-soluble phenol resin, or said photosensitive layer further containing an electron-acceptor or an electron donor. This plate making process must dissolve and remove the photosensitive layer corresponding to the non-image area. Therefore, this process has drawbacks in that it requires of a large-scale equipment and the plate making speed is slow.

(4) The plate prepared by forming a photosensitive layer on the electrically conductive substrate, said photosensitive layer comprising a charge carrier generating material such as a barbituric acid derivative, a thiobarbituric acid derivative or the like and a binder resin. This plate making process has deficiencies in that it is complicated and requires a long period of time.

(5) The plate prepared by forming a specific resin layer on the generally known electrophotographic element. The "specific resin layer" referred to herein is a surface layer which comprises a vinyl ether-maleic anhydride copolymer and a hydrophobic resin compatible therewith. This layer is designed so that a toner image is formed, thereafter the non-image area is treated with an alkali for hydrolytically opening the ring of the acid anhydride, and thus this layer is made hydrophilic (a hydrophilicable layer). In this plate, its printing durability was 500–600 sheets at the most. The reason for the low durability is that the vinyl ether-maleic anhydride copolymer used therein, when being in the ring-opened and hydrophilic state, becomes water soluble and even if the layer is the product of mutual solubility with another hydrophobic resin its water resisting property is markedly inferior.

When increasing the percentage of said hydrophobic resin in the layer in order to improve the water resisting property at this stage, naturally, the hydrophilic property of the layer surface deteriorates, whereby ink tends to easily adhere to the non-image area and the printed matter is apt to become stained. Therefore, it is difficult to meet both the hydrophilic and the water resisting property requisites for the lithographic printing plate by blending the hydrophilic but water resisting property-free resin with the water-resisting but hydrophobic resin. This procedure can never solve this fundamental problem.

SUMMARY OF THE INVENTION

It is an object of the present invention to provide a plate for use in lithographic printing which has a high printing durability and produces a high-quality and clear-cut printed image, and another object of the present invention is to provide a plate which may be made at high speed plate making by the use of simple equipment.

That is, the plate according to the present invention is characterized by forming a photoconductive layer (an electrophotographic photosensitive layer) on an electrically conductive substrate, and further forming thereon a surface layer (a hydrophilic layer) consisting essentially of the reaction product of a resin containing an acid anhydride group and a crosslinking agent.

This surface layer is originally hydrophobic, but when dipped in an aqueous alkaline solution, the acid anhydride group contained in the surface of the surface layer and adjacent thereto is hydrolytically-ring opened into a hydrophilic group. Therefore, said surface may be said to have a property of changing from hydrophobic to hydrophilic.

As the resin forming the surface layer, for instance, there can be enumerated reaction products of copolymers containing maleic anhydride as one copolymer component and the crosslinking agents such as polyisocyanate compounds and the like.

DETAILED DESCRIPTION OF THE PREFERRED EMBODIMENTS

Figure 1:
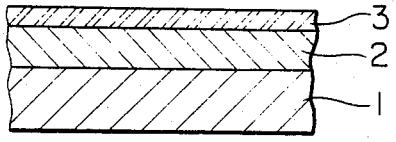
FIGS. 1, 2, 3 and 4 are enlarged sectional views of typical 4 examples of the plate for use in the lithographic printing according to the present invention.

FIG. 1 is a sectional view of the basic plate according to the present invention. 1 denotes an electrically conductive substrate, 2 denotes a photoconductive layer (photosensitive layer), and 3 denotes a surface layer consisting essentially of a reaction product of an acid anhydride group-having resin and a crosslinking agent (a hydrophilicable layer).

As the electrically conductive substrate 1, there can utilized for instance plastic films having an electrically conductive surface such as an aluminium vapordeposited film or the like; papers subjected to water resistance-solvent resistance treatment and conductive treatment; metal plates such as aluminium plate, zinc plate, copper plate, stainless plate and the like; bimetal plates such as copper-aluminium plate, copper-stainless plate, chrome-copper plate and the like; trimetal plates such as chrome-copper-aluminum plate, chrome-lead-iron plate, chrome-copper-stainless plate and the like, and the like.

The photoconductive layer (electrophotographic photosensitive layer) 2 can employ every photoconductive materials, irrespective of inorganic photoconductive compounds and organic photoconductive compounds.

As inorganic photoconductive materials, there can be enumerated, for instance, zinc oxide, titanium oxide, zinc sulfide, selenium, selenium alloy, cadmium sulfide, cadmium selenide, silicone and the like. These materials may form a photoconductive layer together with a binder resin or may singly form a photoconductive layer by means of vacuum evaporation, sputtering or the like.

As organic photoconductive materials, on the other hand, the following can be enumerated:

(1) Cationic dyes including triphenylmethane dyes such as Malachite Green, Crystal Violet and the like, thiazine dyes such as Methylene Blue, Methylene Green and the like, Astrazone dyes such as Astrazone Orange R, Astrazone Yellow 3GL, Astrazone Red 6B and the like, Cyanine dyes such as Aizen Astra Phloxine FF and the like, Xanthene dyes such as Rhodamine B and the like, and Pyrylium dyes such as 2,6-diphenyl-4-(N,N-dimethylaminophenyl)thiapyrylium perchlorate, benzopyrylium salt and the like.

(2) perylene pigments such as perylene acid anhydride, imide perylenate and the like, (3) indigo pigments, (4) quinacridone pigments, (5) polycyclic quinones such as anthraquinones, pyrenequinones, anthoanthros and flavanthrones, (6) bisbenzimidazole pigments, (7) squaric methyen dyes, (8) indanthrone pigments, (9) phthalocyanine pigments comprising metal phthalocyanines such as copper phthalocyanine and the like and non-metal phthalocyanines,

(10) charge transfer type complex comprising an electron donator such as poly-N-vinylcarbazole or the like and an electron acceptor such as 2,4,7-trinitrofluorenone or the like,

(11) eutectic complexes comprises pyrilium salt dyes and polycarbonate resins,

(12) barbituric acid derivatives or thiobarbituric acid derivatives,

(13) azo pigments such as monoazo pigments, trisazo pigments or the like. As the monoazo pigments there can be enumerated for instance monoazo pigments with anthraquinone, N-phenylcarbazole and the like as the central skeleton; as the disazo pigments there can be enumerated benzidine pigments such as Dian Blue, Chlorodian Blue and the like or disazo pigments with N-ethylcarbazole, stilbene, distyrylbenzene, naphthalene, fluorenone, fluorene, anthraquinone, 2,5-diphenyl-1,3,4-oxadiazole, dibenzothiophene, dibenzothiophene dioxide, acridone, phenanthrenequinone and the like as the central skeletone; and as the trisazo pigments there can be enumerated trisazo pigments with triphenylamine or N-phenylcarbazole and the like as the central skeleton and the like.

(14) photosensitive high polymer compounds such as poly-N-vinylcarbazole, poly-N-vinylcarbazole halide, polyvinyl pyrene, polyvinyl anthracene and the like, and

(15) compounds including oxadiazole compounds such as 2,5-bis(4-diethylaminophenyl)-1,3,4-ozadiazole, 2,5-bis[4-(4-diethylaminostyryl)phenyl]-1,3,4-ozadiazole, 2-(9-ethylcarbazollyl-3-)-5-(4-diethylaminophenyl)-1,3,4-oxadiazole and the like; pyrazoline compounds such as 1-phenyl-3-(4-diethylaminostyryl)-5-(4-diethylaminophenyl)pyrazoline, 1-phenyl-3-(4-dimethylaminostyryl)-5-(4-dimethylaminophenyl)pyrazoline and the like; diphenylmethane compounds such as 2,2'-dimethyl-4,4'-bis(-diethylamino)triphenylmethane, 1,1-bis(4-dibenzylaminophenyl)propane, tris(4-diethylaminophenyl)methane and the like; fluorene compounds such as 9-(4-dimethylaminobenzylidene)fluorene, 3-(9-fluoroenylidene)-9-ethylcarbazole and the like; styrylanthracene compounds such as 9-(4-diethylaminostyryl)anthracene, 9-bromo-10-(4-diethylaminostyryl)anthracene and the like; distyrylbenzene compounds such as 1,2-bis(4-diethylaminostyryl)benzene, 1,2-bis(2,4-dimethoxystyryl)benzene and the like; hydrazone compounds such as 9-ethylcarbazole-3-aldehyde 1-methyl-1-phenylhydrazone, 9-ethylcarbazole-3-aldehyde 1-benzyl-1-phenylhydrazone, 4-diethylaminobenzaldehyde 1,1-diphenylhydrazone, 2,4-dimethoxybenzaldehyde 1-benzyl-1-phenylhydrazone, 4-diphenylaminobenzaldehyde 1-methyl-1-phenylhydrazone and the like; stilbene compounds such as 4-diphenylaminostilbene, 4-dibenzylaminostilbene, 4-ditolylaminostilbene, 4-benzylphenyl aminostilbene and the like; styryl naphthalene compounds such as 1-(4-diphenylamino styryl)-naphthalene, 1-(4-dibenzylaminostyryl)naphthalene and the like; α-phenyl stilbene compounds such as 4'-diphenylamino-α-phenylstilbene, 4'-methylphenylamino-α-phenylstilbene and the like; styryl carbazole compounds such as 3-styryl-9-ethylcarbazole, 3-(4-diethylamino)styryl-9-ethylcarbazole and the like; 2,4,7-trinitro-9-fluorenone 2,4,5,7-tetranitro-9-fluorenone 2,6,8-trinitro-4H-indino[1,2-b]thiophene-4-on 1,3,7-trinitrodibenzothiophene-5,5-dioxide and the like.

As the binder resins, there can be enumerated for instance polyamide, polyurethane, polyester, epoxy resin, polycarbonate resin, polystyrene, polyacrylamide, polyvinylacetal and the like.

Figure 2:
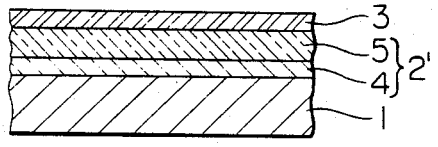

The photoconductive layer may be formed of a mono-layer, but may be formed of two or more layers as shown in FIG. 2. In the case where the photoconductive layer 2 is formed of a mono-layer as shown in FIG. 1, there are considerably various ways of forming said layer, such as by (a) vapor deposition of selenium, selenium alloy or the like, (b) dispersing the inorganic photoconductor such as zinc oxide, cadmium sulfide or the like or the organic pigment such as copper phthalocyanine pigment, azo pigment or the like in a binder resin, (c) further adding the compound as shown in the preceding (15) or the high molecular compound as shown in the preceding (14) to said b, (d) combining the compound as shown in the preceding (15) with a binder resin, (e) further adding the dye as shown in the preceding (1) to said d, (f) using the charge transfer type complex as shown in the preceding (10) and the like.

In the case where the photoconductive layer is multi-layered, there is, for instance, one type which comprises laminating a charge carrier generating layer consisting of said inorganic photoconductor or organic pigment such as phthalocyanine pigment, azo pigment or the like and a binder resin to be added if needed and a charge transfer layer consisting of said compound as shown in the preceding (15) and a binder resin.

Said plate is as shown in FIG. 2. In FIG. 2, 2' denotes a photoconductive layer, 4 denotes a charge carrier generating layer and 5 denotes a charge transporting layer.

Figure 3:
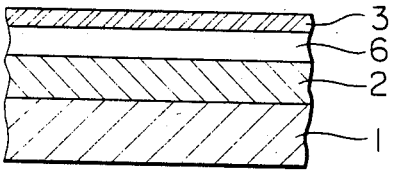
Figure 4:
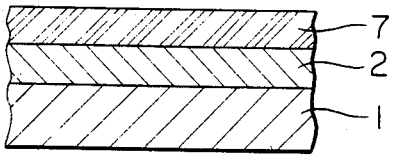

As another example of the plates of the present invention there can be enumerated one comprising a laminated substrate 1, a photoconductive layer 2 and an insulating layer 6 in the order named and further forming a surface layer 3 on the insulating layer 6 (see FIG. 3), and the one comprising laminated a substrate 1, a photoconductive layer 2 and further laminated, on the same date, a layer (an insulating-hydrophylicable layer) 7 which is usable both as an insulating layer and a hydrophilic layer (see FIG. 4) and further acts as an insulating layer at the time of image formation. In this instance, it is needless to say that in this plate, the photoconductive layer, as seen in FIG. 2, may be constructed by lamination of the charge carrier generating layer 4 and the charge transporting layer 5.

As is clarified in the description that will follow, a printing plate can be obtained from the plate of the present invention by forming a toner image on a surface layer (a hydrophilicable layer) 3 by means of an electrophotographic method and successively making the surface layer, which corresponds to a non-image area, hydrophilic.

Since the surface layer 3 is thus subjected to hydrophilicable treatment, as described above, this surface layer 3 consists essentially of a resin containing a hydrophobic group which is changeable into a hydrophilic group by hydrolysis. More precisely, this hydrophilicable layer 3 is formed of a reaction product of an acid anhydride group-possessing resin and a crosslinking agent. The term "hydrophilic treatment" means the treatment for making the surface layer hydrophilic.

As typical examples of resins having acid anhydride groups, there can be enumerated a copolymer having maleic anhydride as one copolymer component [which will be called "maleic anhydride copolymer" for the sake of convenience]. Said maleic anhydride copolymers include for instance copolymers of a maleic anhydride and lower alkyl vinyl ethers such as methyl vinyl ether, ethyl vinyl ether, 2-chloro vinyl ethyl ether, propyl vinyl ether, isopropyl vinyl ether, n-butyl vinyl ether, 2-methoxyethyl vinyl ether and the like, a styrene-maleic anhydride copolymer, an ethylene-maleic anhydride copolymer, a vinyl acetate-maleic anhydride copolymer and the like. Said maleic anhydride copolymer can be used, even when its acid anhydride group has partly ring-opened hydrolytically, so far as a sufficient hydrophobic property can be maintained.

As the typical examples of crosslinking agents there can be enumerated polyisocyanate compounds, polyhydroxy compounds, amines and the like.

Of these crosslinking agents, the polyisocyanate is profitably used because it improves the printing durability of printing plate as compared with the other crosslinking agents (polyhydroxy compounds and amines).

As polyisocyanate compounds, there can be used, for instance, aromatic polyisocyanates such as toluene-2-4-diisocyanate, toluene-2,6-diisocyanate, naphthylene-1,5-diisocyanate, 3,3'-dimethyl biphenyl-4,4'-diisocyanate, diphenylmethane-4,4'-diisocyanate, triphenylmethane-4,4',4''-triisocyanate, tris(p-isocyanatephenyl)thiophosphite, polymethylenepolyphenyl isocyanate, xylylenediisocynate and the like; or aliphatic polyisocyanates such as hexamethylene diisocyanate, trimethyl hexamethylene diisocynate, isophorone diisocyanate and the like; or their dimers, trimers and the like.

The hydrophilicable layer 3 comprising the reaction product of the acid anhydride group possessing resin and the crosslinking agent as a surface layer is formed by dissolving for instance the maleic anhydride copolymer in the active hydrogen-free organic solvent such as dioxane, tetrahydrofuran, dimethylformamide, or the like; adding therein, for instance, the polyisocyanate compound; applying the thus obtained solution on the electrophotographic photosensitive layer 2 formed on the electrically conductive substrate 1; drying; and further subjecting the same to heat treatment for crosslinking the maleic anhydride copolymer with the polyisocyanate compound.

The heat-treating temperature and time for effecting the crosslinking reaction, although somewhat subject to change depending on the combination of the acid anhydride group possessing resin with the crosslinking agent used and the amount of the crosslinking agent added, are suitably selected from the range of 80°–200° C. and several minutes to several hours in the combination of the maleic anhydride copolymer with the polyisocyanate compound. In order to promote the crosslinking reaction, furthermore, there may be added, to said solution, suitable amount of a metal compound such as dibutyl tin dilaurylate, dibutyl tin diacetate, lead 2-ethylhexanate, titanium tetrabutoxide, tin octenoate, dibutyl tin di(2-ethyl hexoate), sodium-o-phenyl, potassium oleate, bismuth nitrate, 2-ethylhexyl titanate, tin chloride, zinc naphthenate, antimony trichloride or the like; or the suitable amount of an amines such as triethylamine, triethylenediamine or the like.

As is evident from the explanation up to this point, the hydrophilicable layer 3 consists essentially of a resin obtained by crosslinking the maleic anhydride copolymer with the polyisocyanate compound and curing. However, for the purpose of improving the strength of this layer 3, improving the adhesive property of this layer 3 to the electrophotographic photosensitive layer 2 or improving the holding characteristic of an electrostatic latent image, different resins can be added, such as polyester resin, polyamide resin, polycarbonate resin, acrylic resin, polystyrene resin, vinyl acetate resin, vinyl acetate resin and the like. In this case, however, it is necessary that the amount of the "acid anhydride group-possessing resin" component occupying the hydrophilicable layer 3 should be 50 wt.% or more. In case the content of said resin containing the anhydride group is less than 50 wt.%, the rate of making layer 3 hydrophilicable is slow and the hydrophilic property after treatment is insufficient. This leads to the results that the non-image area of the printing plate is inked at the time of printing and thus the print background is stained.

For the purpose of improving the developing characteristic at the time of toner development, the adherence of a toner image and the water holding property after the treatment of making the layer 3, the surface of the hydrophilicable layer 3 may be matted mechanically and the layer 3 may contain a matting agent therein. As the matting agent, there can be enumerated fillers such as silicon dioxide, zinc oxide, titanium dioxide, zirconium oxide, glass particles, alumina, clay and the like and polymer particles of polymethyl methacrylate, polystyrene, phenol resin and the like. In addition thereto, the hydrophilicable layer 3 may contain additives, such as a plasticizer and the like.

In the practical preparation of the plate according to the present invention, first the electrophotographic photosensitive layer (photoconductive layer) 2 or 2' is formed on the electrically conductive substrate 1 in a usual manner. In succession, the photoconductive layer 2 or 2' is applied thereon in a solution containing the acid anhydride group possessing resin and the crosslinking agent; then drying the layer; thereafter further subjecting the layer to heat-treatment so as to cause a crosslinking reaction between said acid anhydride group-possessing resin and said crosslinking agent; and forming the surface layer (hydrophilicable layer) 3. Thus, the preparation of said plate is completed.

In this case, as aforesaid, it is possible, as the occasion demands, to provide an insulating layer 6 between the photoconductive layer 2 or 2' and the surface layer 3 (see FIG. 3), to superpose an insulating hydrophilicable layer 7 on the photoconductive layer 2 or 2' (see FIG. 4) and the like.

The thickness of the surface layer 3 is 0.05–10 μm, preferably 0.1–5 μm. In case less than 0.05 μm, it is impossible to form a high quality hydrophilic surface after the hydrophilicable treatment, while in case over 10 μm, there take place disadvantages that the sensitivity required for the electrophotographic photosensitive element deteriorates, the residual potential rises and the like.

This layer 3 or 7 has a hydrophobic and high-resistance surface, but when properly treated, it has the ability to readily change into a hydrophilic surface.

The plate according to the present invention is typically made in the following manner. First, a plate is uniformly charged in the dark using a corona charger according to a usual electrophotographic method, and then is exposed to light to thereby form an electrostatic latent image. This exposure is effected by means of the reflected image exposure using a light source such as tungsten lamp, xenon lamp or fluorescent lamp, the contact exposure through a transparent positive film, or scanning exposure using He—Ne laser, argon laser, laser diode or the like.

The electrostatic latent image is developed by a toner and fixed, thereby forming a toner image on the hydrophilicable layer 3. Successively, the same is dipped in an aqueous alkaline solution (hydrophilicable-treating solution) for the purpose of changing the non-image area unmasked by said toner image, namely the exposed portion of the hydrophilicable layer (surface layer) 3 from hydrophobic to hydrophilic, and thus there is obtained a printing plate. The term "hydrophilicable-treating solution" means a solution for making the surface hydrophilic.

As the means for developing the toner image, there can be employed the well known methods in the conventional electrophotography, such as cascade development, magnetic brush development, powder-cloud development, liquid development and the like. The developed toner image can be fixed by the well known methods, namely the thermofixing method using heat radiation, hot rollers and the like and the pressure fixing method.

The plate making means utilized in the above mentioned "usual electrophotographic methods" are applicable to both plates shown in FIG. 1 to FIG. 4. However, in the case of using the plates shown in FIG. 3 and FIG. 4, the following means can be employed, for instance:

(1) After the element is charged with a specific polarity, it is charged with a polarity opposite thereto. During the latter charging, the element is exposed to imagewise irradiation of light, thereby obtaining a latent image thereon, (2) Simultaneously with, or immediately after being charged with a specific polarity, the element is uniformly exposed to light, then simultaneously with or immediately after charge of a polarity opposite thereto is imposed and, the element is exposed to imagewise irradiation of light, thereby obtaining a latent image thereon. In the preceding (2), it is possible to obtain a positive image or a negative image selectively by controlling the charged amount and/or the amount of imagewise irradiation.

In the case of the plate or the lithographic printing plate made by plate making therefrom, the surface of the hydrophilicable layer corresponding to the toner-free non-image area is made hydrophilic by the action of the hydrophilicable-treating liquid. Therefore, it is preferable that the toner component should contain a resin ingredient which has a property to resist the hydrophilicable treating liquid. Such a resin ingredient may be sufficient if it is not soluble in the hydrophilicable treating liquid. As suitable examples of such resin ingredients, there can be enumerated for instance acrylic resins such as methacrylic acid, ester of methacrylic acid and the like, polyvinylacetate, copolymer of vinyl acetate and ethylene or vinyl chloride and the like, vinyl acetal resins, vinylchloride resins, vinylidenechloride resin, polyvinyl butyral, polystyrene, styrene-butadiene copolymer, ester of polymethacrylic acid, polyethylene, polypropylene or chlorides thereof, polycarbonate resin, polyester resin, polyamide resin, phenol resin, xylene resin, alkyd resin, wax, polyolefin and the like.

The concrete examples of the aqueous alkaline solutions for use in making the surface layer hydrophilic include aqueous alkaline solutions of inorganic salts such as sodium silicate, sodium phosphate, sodium hydroxide and potassium hydroxide, ammonia water, and aqueous alkaline solutions containing organic amines such as ethanol amine, diethanol amine, triethanol amine, propanol amine, diisopropanol amine, butanol amine, ethylene diamine and the like. In addition, as occasion demands, there may be used aqueous alkaline solutions with organic solvents such as ethanol, benzyl alcohol, ethylene glycol, glycerine and the like or surface active agents.

The hydrophilicable speed varies depending on the composition of the surface layer 3, the degree of cross-linking, the prescription of the hydrophilicable treating liquid and the like. By selecting the pertinent combination and selection of the treating conditions, however, said speed may be shortened to 1–30 seconds/plate. After the completion of said hydrophilicable treatment, if needed, there can be employed the steps of washing with water and drying.

The non-image area (background) of the thus obtained lithographic printing plate displays a desirable hydrophilic property. This hydrophilic property can be confirmed by measuring, for instance, its contact angle to the water. In more detail, the surface layer 3 (hydrophilicable layer) before undergoing the hydrophilicable treatment forms a contact angle of about 60°–80°, but after said treatment, the contact angle lowers to about 10°–15°, whereby it is very likely to be wet. Due to this, on the printing plate there is formed an image area consisting of an oleophilic toner and a highly hydrophilic non-image area.

In this regard, the method for forming a toner image includes, in addition to the aforesaid usual electrophotographic method, for instance (1) the method for obtaining a toner image comprising forming an electrostatic latent image on another electrophotographic photosensitive element, electrostatically transferring said electrostatic latent image, and developing said image, thereby obtaining a toner image, (2) the method for obtaining a toner image which comprises impressing an electric signal on a multi-needle electrode, forming an electrostatic latent image corresponding to said signal and developing said image, and (3) the method for obtaining a toner image comprising forming an electrostatic latent image on a screen-like electrophotographic photosensitive element having a multiplicity of fine openings, effecting corona charge treatment through this electrostatic latent image, making the ion current of corona irregular for forming an electrostatic latent image, developing said image and obtaining a toner image. The hydrophilicable layer according to the present invention is also applicable to this case. This problem can be solved by using the plate for lithographic printing which comprises providing the hydrophilicable layer directly on the electrically conductive substrate.

As is evident from the foregoing, when using the hydrophilicable layer according to the present invention in the hitherto known electrophotographic elements, every conventional electrophotographic element can be used as a high quality plate for use in lithographic printing. The hydrophilicable layer, after undergoing the hydrophilicable treatment, may be said to be a film which is usable both as a high hydrophilic film and as a high water resisting film, and is extremely superior in adherence to both the substrate and the toner image. Therefore, the thus obtained plate is of a high printing durability which can produce more than tens of thousands of printed matters.

Furthermore, since the plate of the present invention can hold substantially the same original sensitivity of the electrophotographic photosensitive layer, there can be obtained a markedly highly-sensitive plate as compared with the plate for use in making the usual electrophotographic plate. Still further, in view of the fact that usually one layer must have possess photoconductivity and hydrophilicability, only very limited materials such as zinc oxide, could be used. In the plate according to the present invention, contrarily, the function is divided in the photoconductive layer and the hydrophilicable layer, and so the selection range is broadened, whereby when a material which is highly sensitive to long wavelength light ranges is selected, it makes it possible to write with a He—Ne laser and a laser diode laser.

According to the plate of the present invention, the non-image area is made hydrophilic by dipping said plate in an aqueous alkaline solution for several seconds, and therefore plate making can be done at high speed by means of a small-scale simple equipment.

EXAMPLES

In the following examples and comparative examples, part means wholly part by weight.

EXAMPLE 1

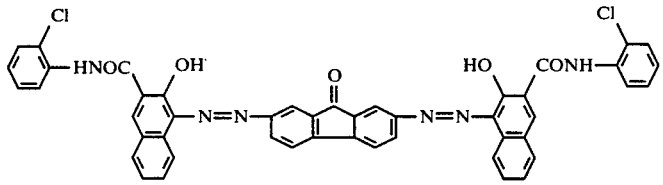

1 part

| | |
|---|---|
| tetrahydrofuran | 19 parts |
| 5 wt. % tetrahydrofuran solution of polyvinyl butyral resin (DENKA BUTYRAL #4000-1 produced by DENKI KAGAKU KOGYO K.K.) | 6 parts |

A mixture of abovementioned components was fully pulverized in a ball mill. Next, this mixture was taken out and was added with 104 parts of tetrahydrofuran, while stirring gently, for diluting. This solution was applied, leaving a wet gap of 35 μm, on an aluminum-vapordeposited polyester film (an electrically conductive substrate) with a thickness of about 100 μm by means of a doctor blade and dried at 80° C. for 5 minutes to thereby form a charge carrier generating layer having a thickness of about 0.8 μm.

A solution comprising the following components was applied, leaving a wet gap of 200 μm, on this charge carrier generating layer by means of a doctor blade, and dried at 80° C. for 2 minutes and successively at 105° C. for 5 minutes to thereby form a charge transporting layer having a thickness of about 18.5 μm:

| | |
|---|---|
| hydrazone compound | 10 parts |

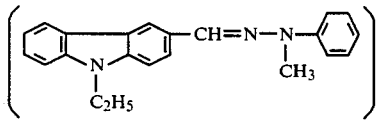

| | |
|---|---|
| polycarbonate resin (Panlite K-1300 produced by TEIJIN KASEI K.K.) | 10 parts |
| tetrahydrofuran | 80 parts |

A mixture of 1 part of methyl vinyl ether-maleic anhydride copolymer (polymerization molar ratio 1:1 produced by Aldrich Chemical Company), 0.17 part of toluene-2,4-diisocyanate, 0.02 part of tin dibutyl dilaurate, and 32 parts of 1,4-dioxane was applied, leaving a wet gap of 35 μm, on the thus prepared electrophotographic photosensitive element by means of a doctor blade, was dried at 100° C. for 5 minutes and was subjected to heat treatment at 150° C. for 2 hours for curing to thereby form a hydrophilicable layer (a surface layer) having a film thickness of about 1.1 μm.

The thus obtained plate was subjected to −6 KV corona discharge for 20 seconds by means of the electrostatic copying paper tester (Model SP-428 produced by Kawaguchi Electro Works) and was charged negatively. Thereafter, this plate was left standing in the dark for 20 seconds and the surface potential Vpo(V) at the time was measured. Then, the plate was exposed to irradiation of tungsten lamp light so that the surface illumination might become 4.5 lux. The time (second) required until the surface potential became $\frac{1}{2}$ of Vpo was obtained and the half decay exposure amount $E_{\frac{1}{2}}$ was calculated therefrom. The obtained results were Vpo = −1120 (V) and $E_{\frac{1}{2}}$ = 1.4 (lux.sec).

Next, this plate was set in the electrostatic copying plate making machine Model S-1 so as to subject the plate to charge, imagewise exposure, development and fixing, thereby forming a clear-cut toner image on the hydrophilicable layer. This toner-image carrying plate was dipped for 5 seconds in an aqueous 0.5 wt.% sodium silicate solution (hydrophilicable-treating liquid), thereafter washed with water and dried for making the non-image area surface hydrophilic. In order to confirm that the surface became hydrophilic, the contact angle formed with the water was measured. The measured angle was about 10° (in this connection, the contact angle before hydrophilicable treatment was 65°).

The thus made lithographic printing plate was set in the offset press (autoprinter Model 4600 produced by RICOH COMPANY, LTD.), and printing was carried out in a usual manner. 50,000 sheets of clear-cut printed matters could be printed. Their backgrounds were not stained.

EXAMPLE 2

A solution comprising the following composition was applied, leaving a wet gap of 35 μm, on the electrophotographic photosensitive element provided with the photosensitive layer according to the same procedure as Example 1 by means of a doctor blade, was dried at 100° C. for 5 minutes, and further heat-treated at 150° C. for 2 hours for curing to thereby obtaining a hydrophilicable layer (a surface layer) having a film thickness of about 1.3 μm.

| | |
|---|---|
| methylvinyl ether-maleic anhydride copolymer (polymerization molar ratio 1:1 produced by Aldrich Chemical Company) | 1 part |
| diphenylmethane-4,4'-diisocyanate | 0.15 part |
| 1,4 dioxane | 32 parts |

A toner image was formed on this plate according to the same procedure as Example 1. This plate was further dipped in an aqueous 1 wt.% sodium silicate solution for 15 seconds, thereafter was washed with water and dried for making the non-image area surface hydrophilic. In order to confirm that the surface became hydrophilic, the contact angle formed with the water was measured. The measured angle was about 15° (in this connection, the contact angle before hydrophilicable treatment was 68°).

The thus made lithographic print plate was put to printing according to the same procedure as Example 1, 50,000 sheets of clear-cut printed matters could be printed. Their backgrounds were not stained.

EXAMPLE 3

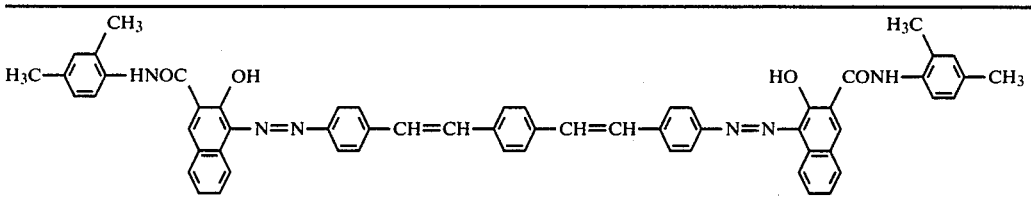

1 part polyester resin (VYLON 200: produced by TOYOBO K.K.) 0.3 part
tetrahydrofuran 60 parts A mixture comprising the above components was pulverized fully in a ball mill. This was applied, leaving a wet gap of 35 μm, on an aluminum-vapordeposited polyester film (an electrically conductive substrate) by means of a doctor blade and was dried at 80° C. for 5 minutes to thereby form a charge carrier generating layer having a thickness of about 0.8 μm.

A charge transporting layer having a thickness of about 19.0 μm by repeating the exactly same procedure as Example 1.

A solution comprising 1 part of methyl vinyl ether-maleic anhydride copolymer (polymerization molar ratio 1:1 produced by Aldrich Chemical Company), 0.11 part of toluene-2,4-diisocyanate and 32 parts of 1,4-dioxane was applied, leaving a wet gap of 35 μm, on the thus prepared electrophotographic photosensitive element by means of a doctor blade, was dried at 100° C. for 5 minutes and was heat-treated at 150° C. for 2 hours for curing to thereby form a hydrophilic layer (a surface layer) having a film thickness of about 1.3 μm. This layer was measured with reference to Vpo and $E_{\frac{1}{2}}$ to find that Vpo = −1035 (V) and $E_{\frac{1}{2}}$ = 2.1 (lux.sec).

In succession, a toner image was formed on the thus obtained plate according to the same procedure as Example 1, further the same was dipped in an aqueous 0.5 wt.% sodium silicate solution for 5 seconds, thereafter was washed with water and dried for making the non-image area surface hydrophilic.

The thus made lithographic printing plate was put to printing according to the same procedure as Example 1. 50,000 sheets of printed matters could be printed which was free from background stain and very clear-cut.

EXAMPLE 4

A charge carrier generating layer-forming solution was prepared by dissolving 1 part of Chloro Dian Blue, benzidine system disazo pigment, in 22.65 parts of ethylene diamine, adding 18.59 parts of n-butylamine in this solution with stirring, and further adding 50.33 parts of tetrahydrofuran. This solution was applied on an aluminum-vapordeposited polyester film by means of a doctor blade, dried at 80° C. for 5 minutes to form a charge carrier generating layer having a thickness of about 0.5 μm.

A solution comprising the following components was applied, leaving a wet gap of 200 μm, on this charge carrier generating layer. The same was dried at 80° C. for 2 minutes and in succession was dried at 105° C. for 5 minutes, thereby forming a charge transporting layer having a thickness of about 19.0 μm.

(pyrazoline compound) 10 parts

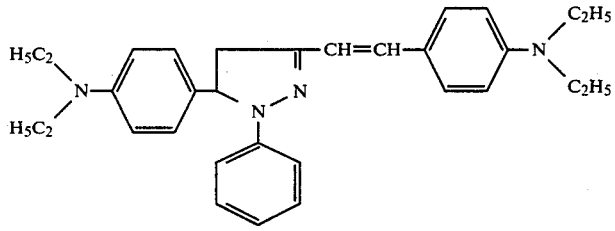

polycarbonate resin (Panlite K-1300) 10 parts
tetrahydrofuran 80 parts

A solution comprising 1 part of styrene-maleic anhydride copolymer (polymerization molar ratio 1:1 produced by Aldrich Chemical Company), 0.09 parts of toluene-2,4-diisocyanate and 32 parts of 1,4-dioxane were applied, leaving a wet gap of 35 μm, on the thus prepared electrographic photosensitive element by means of a doctor blade. The same was dried at 100° C. for 5 minutes, and further was subjected to heat-treatment at 150° C. for 2 hours for curing, thereby forming a hydrophilicable layer (a surface layer) having a film thickness of about 1.1 μm. This layer was measured with reference to Vpo and $E_{\frac{1}{2}}$ to find that Vpo = −705 (V) and $E_{\frac{1}{2}}$ = 2.5 (lux.sec). In succession, a toner image was formed on the thus obtained plate according to the same procedure as Example 1. Further, the same was dipped in an aqueous 0.5 wt.% sodium silicate for 5 seconds, thereafter was washed with water and dried for making the non-image area surface hydrophilic. The thus made lithographic printing plate was put to print according to the same procedure as Example 1 to find that 50,000 sheets of printed matters could be printed which were free from background stain and exceedingly clear-cut.

EXAMPLE 5

A charge carrier generating layer having a thickness of about 0.1 μm was formed by vacuum vapordepositing a perillene pigment represented by the above structural formula:

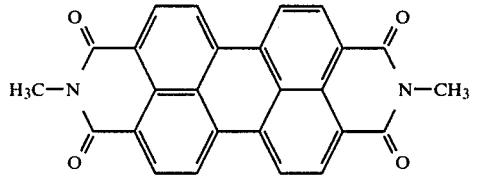

on an aluminum plate (an electrically conductive substrate) under the conditions: vacuum $10^{-5}$ mmHg, vapordeposition source temperature 350° C., vapordeposition time 3 minutes.

A solution comprising the following components was applied on this charge carrier generating layer and the same was dried at 120° C. for 10 minutes to thereby form a charge transporting layer having a thickness of about 10 μm.

| | |
|---|---|
| (oxadiazole compound) | 5 parts |
| 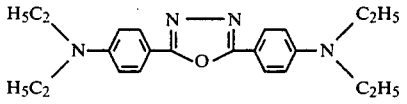 | |
| polyester resin (Polyester Adhesive 49000 produced by du Pont) | 5 parts |
| tetrahydrofuran | 90 parts |

On the thus prepared electrophotographic photosensitive element there was formed a surface layer having a thickness of about 1μ according to the procedure as Example 4 (wherein, the amount of toluene-2,4-diisocyanate was changed from 0.09 parts to 0.13 parts, while the amount of 1,4-dioxane was changed from 32 parts to 49 parts). This layer was measured with reference to Vpo and $E\frac{1}{2}$ to find that Vpo = −1025 (V) and $E\frac{1}{2}$ = 7.3 (lux.sec).

In succession, a toner image was formed on the thus obtained plate by repeating exactly the same procedure as Example 1. The same was further dipped in an aqueous 0.5 wt.% sodium silicate solution for 5 seconds, thereafter was washed with water and dried for making the non-image area surface hydrophilic.

The thus made lithographic printing plate was put to print according to the same procedure as Example 1 to find that 50,000 sheets of printed matter could be printed which were free from background stain and exceedingly clear-cut.

COMPARATIVE EXAMPLE 1

On the electrophotographic photosensitive element according to Example 1 there was applied, leaving a wet gap of 25 μm, a solution comprising the following components by means of a doctor blade to thereby form a hydrophilicable layer (a surface layer) having a film thickness of about 1.3 μm.

| | |
|---|---|
| methylvinyl ether-maleic anhydride copolymer (polymerization molar ratio 1:1 produced by Aldrich Chemical Company) | 0.7 part |
| polyvinyl chloride (produced by Nihon Gosei K.K.) | 0.3 part |
| 1,4-dioxane | 19 parts |

After a toner image was formed on this plate according to the same procedure as Example 1, this plate was dipped in a hydrophilicable-treating solution comprising 10 ml of diethanol amine, 67 ml of ethylene glycol and 23 ml of glycerine for 5 seconds, was washed with water and was dried, making the non-image area hydrophilic.

The thus made lithographic print plate was put to printing according to the same procedure as Example 1 to find that the non-image area on about the 60th print began to be stained and on about the 100th print was wholly stained. The surface of the plate after printing was examined to find that hydrophilic layer (surface layer) had been lost completely at the stained portion.

COMPARATIVE EXAMPLE 2

A plate was prepared by repeating the exactly same procedure as Comparative Example 1 except that in the surface layer-forming solution of Comparative Example 1, the amount of said methyl vinyl ether-maleic anhydride copolymer was changed from 0.7 part to 0.3 parts and the amount of said polyvinyl acetate was changed from 0.3 part to 0.7 parts.

A toner image was formed on this plate according to the same procedure as Example 1. Thereafter, this plate was dipped in the same hydrophilicable-treating solution for 5 seconds, then was washed with water and dried, making the non-image area hydrophilic.

The thus made lithographic print plate was put to printing according to the same procedure as Example 1 to find that the non-image area of about the 300th print began to be stained and the printing durability was less than 300 sheets.

COMPARATIVE EXAMPLE 3

| | |
|---|---|
| β-Cu phthalocyanine pigment (chromophtal blue-4GN produced by Chiba Geigy Company) | 1 part |
| m-cresol formaldehyde resin | 6 parts |
| ethylene glycol monoethyl ether | 30 parts |

A mixture of abovementioned components was pulverized fully in a ball mill, and thereafter 0.64 part of the oxadiazole compound used in Example 5 was added thereto. The same was stirred and dissolved. This solution was applied on a finely uneven 0.25 mm-thick aluminum plate, and was dried at 120°0 C. for 20 minutes to form an about 6 μm-thick photosensitive layer thereon. Thus, there was prepared a plate.

This comparative plate was measured in respect of Vpo and $E\frac{1}{2}$ according to the same procedure as Example 1 except that this plate was subjected to +6 KV charge to find that Vpo = +540 (V) and $E\frac{1}{2}$ = 11.3 (lux sec).

Further, this comparative plate was charged in the dark to be +450 V, and subjected to imagewise exposure using a tungsten light source. The thus obtained electrostatic latent image was subjected to magnetic brush development with a toner (produced by RICOH COMPANY LTD.) for use in RICOPY-FT4060 and wash heat-treated at 120° C. for about 1 minute and fixed, thereby forming a toner image. Successively, it was dipped in an aqueous 1 wt.% sodium silicate in order to dissolve and remove the photosensitive layer corresponding to the non-image area, and further was washed by a current of water while being lightly brushed.

It was found necessary that in this plate making, the plate should be dipped in an aqueous sodium silicate solution for about 1 minute and thereafter should be washed at least for about 30 seconds in order to remove the photosensitive layer corresponding to the non-image area.

COMPARATIVE EXAMPLE 4

| | |
|---|---|
| Chloro Dian Blue (the same as used in Example 4) | 2 parts |
| benzyl metacrylate-methacrylic acid copolymer (polymerization molar ratio 2:1) | 2 parts |
| dichloromethane | 35 parts |

A mixture of abovementioned components was fully pulverized in a ball mill. The thus obtained dispersion was further added with 1 part of the hydrofuran compound represented by the following structural formula and the resulting mixture was stirred and dissolved.

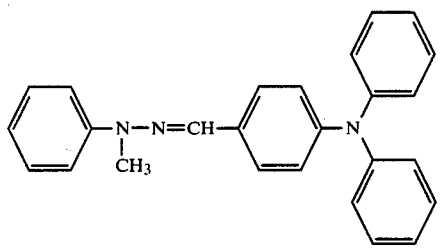

This solution was applied on a finely uneven 0.25 mm-thick aluminum plate, and the same was dried at 120° C. for 20 minutes to thereby form an about 6 μm-thick photosensitive layer. Thus, there was prepared a comparative plate.

This comparative plate was measured in respect of Vpo and $E_{\frac{1}{2}}$ according to the same procedure as Example 1 except that said plate was charged with +6 KV to find that Vpo=+525 (V) and $E_{\frac{1}{2}}$=14.5 (lux.sec).

A toner image was formed on this comparative plate according to the same procedure as Example 1. Thereafter, this plate was dipped in a treating solution comprising 70 g of sodium metasilicate hydrate, 140 ml of glycerine, 550 ml of ethylene glycol and 150 ml of ethanol, and further was washed while lightly brushing with water.

In order to completely remove the photosensitive layer corresponding to the non-image area in this plate making, it was found necessary to dip it in said treating solution for about 1 minute and thereafter wash it with water at least for 30 seconds.

As is apparent from the disclosure of examples and comparative examples, it can be seen that the plate for electrophotographic plate making according to the present invention is very superior in sensitivity as compared with the hitherto well known plate for electrophotographic plate making. Further, it is known that the plate of the present invention provided with the hydrophilicable layer cross-linked by the polyisocyanate compound is extremely high in printing durability as compared with the comparative plates shown in Comparative Example 1 and Comparative Example 2 provided with the hydrophilicable layers comprising vinyl ether-maleic anhydride copolymers and hydrophobic resins.

Still further, in the use of usual photosensitive layer-dissolving type plates for lithographic printing shown in Comparative Example 3 and Comparative Example 4, it has trouble that in plate making, it takes 1.5 minutes or more for treating after the formation of the toner image and further in washing, there is necessity of using a current of water like a shower in order to remove the non-image area thoroughly by washing, and therefore it is necessary to involve large-scale equipment to the plate making machine. If the photosensitive layer corresponding to the non-image area remains in places, it is mingled with the printing ink and stains the background or it adheres in a blanket to thereby cause loss of the image. In contrast, when using the plate for lithographic printing according to the present invention, there is no necessity of attaching any complicated equipment to the plate making machine. The reason is that in plate making, after formation of the toner image, the photosensitive layer corresponding to the non-image area can be made hydrophilic by dipping it in a low concentrated alkaline aqueous solution (a hydrophilicable treating solution) for several seconds, and the subsequent washing can be completed by dipping it in the water for several seconds so as to wash out the hydrophilicable-treating solution adhered to the surface.

I claim:

1. A plate for use in lithographic printing comprising an electrically conductive substrate, a photoconductive layer on said substrate and a hydrophobic overcoat layer on said photoconductive layer, said hydrophobic overcoat layer having a thickness of from 0.05 to 10 μm and consisting essentially of the product obtained by cross-linking a resin containing at least 50 wt.% of a maleic anhydride copolymer with a polyisocyanate cross-linking agent, said hydrophobic overcoat layer being convertible to a hydrophilic overcoat layer by immersing said overcoat layer in an aqueous alkaline solution to effect hydrolysis of said copolymer.

2. A plate as claimed in claim 1 in which the surface of said hydrophobic overcoat layer forms a contact angle, with water, of from about 60° to 80°.

3. A plate as claimed in claim 1 wherein the thickness of said hydrophobic overcoat layer is from 0.1 to 5 μm.

4. A plate as claimed in claim 2 wherein the thickness of said hydrophobic overcoat layer is from 0.1 to 5 μm.

5. A plate as claimed in claim 1 in which said polyisocyanate cross-linking agent is selected from the group consisting of toluene-2,4-diisocyanate, toluene-2,6-diisocyanate, naphthylene-1,5-diisocyanate, 3,3'-dimethyl biphenyl-4,4'-diisocyanate, diphenylmethane-4,4'-diisocyanate, triphenylmethane-4,4',4''-triisocyanate, tris(p-isocyanatophenyl)thiophosphite, polymethylenepolyphenyl isocyanate, xylylene diisocyanate, hexamethylene diisocyanate, trimethyl hexamethylene diisocyanate and isophorone diisocyanate.

6. A plate as claimed in claim 1 in which said hydrophobic overcoat layer has been prepared by dissolving said copolymer in an organic solvent free of active hydrogens to form a solution, adding said polyisocyanate to the solution, then coating said solution on said photoconductive layer and drying same to obtain the overcoat layer, then heating said plate at from 80° to 200° C. for a period of time effective to cross-link said resin.

7. A plate as claimed in claim 6 in which said resin consists of a copolymer of methylvinyl ether and maleic anhydride copolymerized at a molar ratio of 1:1, and said polyisocyanate is toluene-2,4-diisocyanate or diphenylmethane-4,4'-diisocyanate.

8. A plate as claimed in claim 6 in which said resin consists of a copolymer of styrene and maleic anhydride copolymerized at a molar ratio of 1:1, and said polyisocyanate is toluene-2,4-diisocyanate.

* * * * *